United States Patent [19]

Bondi'

[11] Patent Number: 4,804,348

[45] Date of Patent: Feb. 14, 1989

[54] ANIMATED TOY PUPPET THEATER

[76] Inventor: Francesco Bondi', Vicolo Razionale 7/A, 90133 Palermo, Italy

[21] Appl. No.: 81,520

[22] Filed: Aug. 5, 1987

[51] Int. Cl.[4] ..... A63J 19/00; A63H 11/00

[52] U.S. Cl. ..... 446/83; 446/352; 446/366

[58] Field of Search ..... 446/83, 82, 84, 331, 446/332, 334, 335, 352, 366, 361, 362, 368, 190, 191, 183, 184, 272

[56] References Cited

U.S. PATENT DOCUMENTS

| | | | |
|---|---|---|---|
| 1,589,432 | 6/1926 | Sapp | 446/352 X |
| 1,732,197 | 10/1929 | Tadakuma | 446/298 X |
| 2,637,138 | 5/1953 | Doran et al. | 446/83 |
| 2,817,187 | 12/1957 | Auzin | 446/184 |
| 3,763,591 | 10/1973 | Fontana | 446/366 X |
| 4,245,428 | 1/1981 | Bowen | 446/366 |
| 4,344,243 | 8/1982 | Reszka | 446/83 X |
| 4,575,348 | 3/1986 | Wiggs et al. | 446/330 X |

FOREIGN PATENT DOCUMENTS

| | | | |
|---|---|---|---|
| 1265635 | 7/1965 | Fed. Rep. of Germany | 446/366 |
| 352221 | 3/1961 | Switzerland | 446/330 |

*Primary Examiner*—Robert A. Hafer
*Assistant Examiner*—D. Neal Muir
*Attorney, Agent, or Firm*—Albert Josif; Guido Modiano

[57] ABSTRACT

The animated toy puppet theater comprises a box-like frame defining a top surface having a hole formed therein, and a puppet having a head and hollow body, made of flexible material, connected to the head and the top surface. A rod is connected to the head and extends through the hole into the frame. A motor driven cam shaft acts on a cam follower attached to the rod for automatically animating the puppet. An aperture is provided in the frame for permitting manual animation of the puppet. A cover defining an internal surface bearing a background panel is pivotally connected to the frame. The cover defines at least one open position, whereat the background panel lies perpendicular to the top surface.

19 Claims, 1 Drawing Sheet

ANIMATED TOY PUPPET THEATER

BACKGROUND OF THE INVENTION

The present invention relates to an animated toy puppet theater and particularly, to an animated toy puppet theater fitted with puppets which are automatically animated.

Puppets are known consisting essentially of a rigid base on which a flexible body is connected and generally made of fabric or plastic film; on top of the flexible body the head is attached and fixed to a rod extending inside the base and the body. The lower portion of the rod extends outside the rigid base such that by holding the rigid base with one hand and grasping the moving rod with the other hand the puppet can be animated.

SUMMARY OF THE INVENTION

Object of this invention is to provide an animated toy puppet theater of a very simple and economic design, fitted with automatically animated puppets.

A further object of the present invention is to provide an animated toy puppet theater in which the puppets can be animated also manually, overriding the automatic animation.

Still another object is to provide an animated toy puppet theater of sturdy and compact construction that would also occupy a minimum of space when not in use.

An additional object is to provide an animated toy puppet theater with a music box, or any other type of sound reproducer, synchronized with the puppets' movements.

BRIEF DESCRIPTION OF THE DRAWINGS

The present invention, both as to its organization and manner of operation together with further objects and advantages thereof, may best be understood by reference to the following description, taken in connection with the accompanying drawings in which.

DESCRIPTION OF THE PREFERRED EMBODIMENTS

Figure 1:
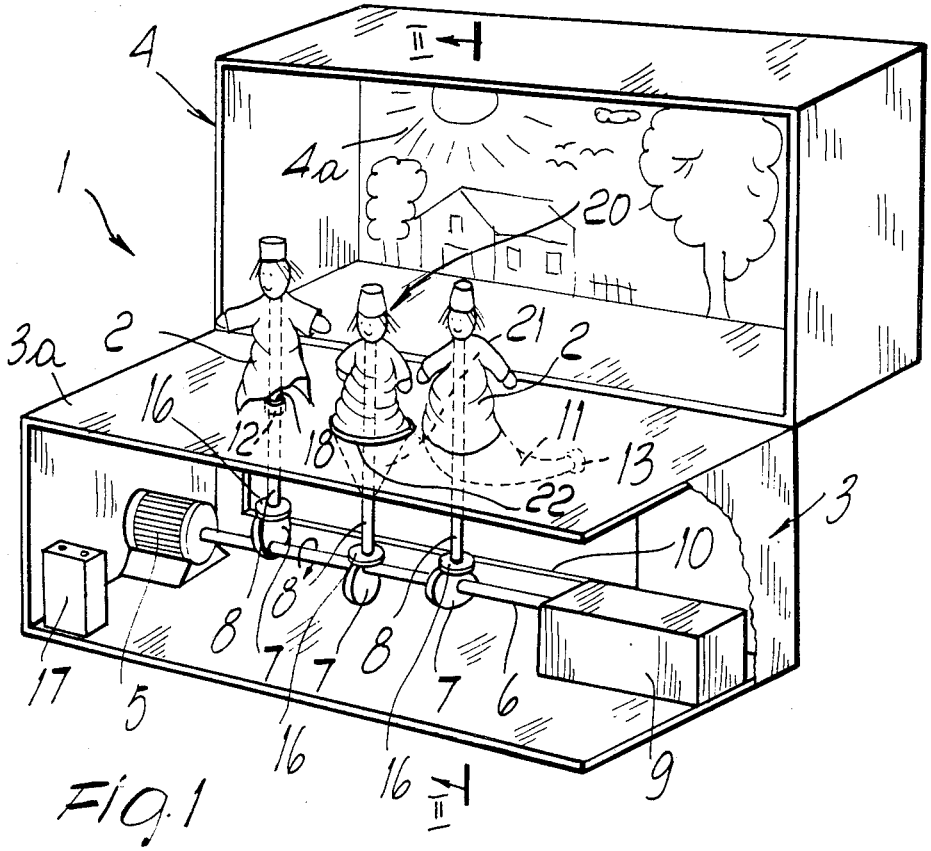
FIG. 1 is a perspective, partially cut away, view of an animated toy puppet theater according to the invention.

The animated toy puppet theater, according to the invention, and generally designated by the numeral 1, comprises a frame 3 having a box-like configuration and supporting a plurality of puppets 2 resting on the top surface 3*a* of the frame 3.

The puppets 2 are essentially composed of a hollow body 2*a* attached to a head 15; the head 15 is connected to, and supported by, a rod 8 hidden from view by the body 2*a* which is made of a flexible material, e.g. fabric.

The hollow body 2*a* is also fixed to the top surface 3*a* of the frame 3 at corresponding holes 18 provided on the frame where the puppets are to be located. The top surface 3*a* providing a rigid base for the puppets 2 and a support for the rods 8.

The rods 8 extend beyond the holes 18 into the frame 3 and by moving them the puppets can be animated.

For this purpose a mechanical system is provided inside the frame 3 composed of a motor 5 fixed to the frame 3 and a cam-shaft 6. At each rod 8 a cam 7 is provided on the cam-shaft 6 acting on the cam-follower 16 of the rod 8.

The motor 5 actuates the cam-shaft 6, its rotation being converted into vertical movements of the rods 8 by means of the cams 7 and cam-followers 16; naturally the shape of the cams 7 determines the type of movement of the puppets 2, with inherent flexing of said hollow body 2*a* made of flexible material and being connected to the head 15 and to the top surface 3*a* of the frame 3. (FIG. 1).

The cams 7 can be variously shaped to provide a selected movement for each of the puppets 2 and any particular synchronism with each other.

In the drawings a single cam-shaft system is shown but more than one cam-shaft 6 can be connected to the motor 5 depending on the number and arrangement of the puppets 2 on the top surface 3*a* of the frame 3.

The animated toy puppet theater is also fitted with a music-box 9 advantageously fixed inside the frame 3 and hidden from view as the mechanical animation system. The music-box 9 can also be of a mechanical type actuated directly by the cam-shaft 6, as it is shown in the drawings, and synchronized with the movements of the puppets 2. The music-box 9 can be replaced by an electronic device, such as a magnetic tape recorder, in order to reproduce voices synchronized with the puppets' movements. In this case the energy source is, for example, a battery 17 which would also feed the electric motor 5.

The puppets 2 of the toy-theater can also be animated manually. This is achieved by providing, on the rear panel of the frame 3, an aperture 10 large enough to introduce a hand to grasp the lower portion of the rods 8.

The rods 8 are supported and guided through the holes 18 by an elastic ring 12 which allows a vertical displacement of the rods 8 when actuated by the cam-shaft and, at the same time, allows a certain degree of inclination of the rods when actuated manually, thus giving a greater variety of movements of the puppets.

Figure 2:
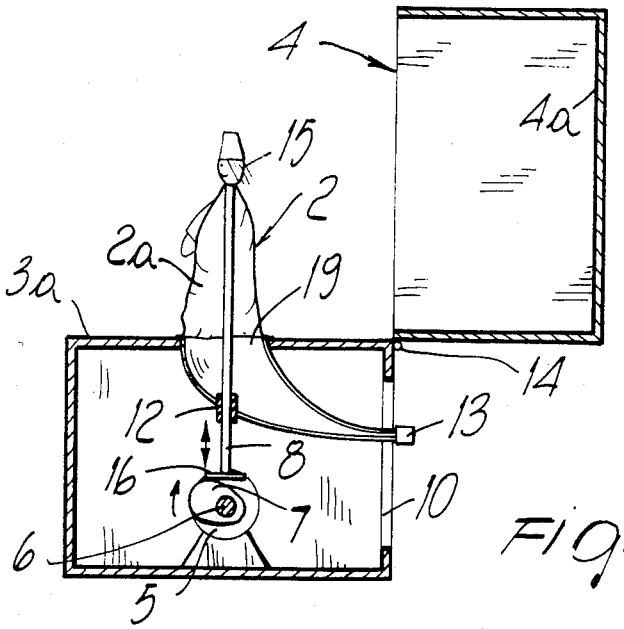
FIG. 2 is a sectioned view, taken along the line II-II of FIG. 1.

In FIG. 2 a slightly different arrangement of the puppet 2 is shown wherein a horn-like base 11 is associated to the puppet 2 at the hole 19 on the surface 3*a*.

The horn-like base 11 has a hole or base hole through which the rod 8 is inserted with the interposition of the elastic ring 12. The base 11 has an extremity reaching the aperture 10 and fitted with a whistle 13, the mouthpiece thereof being at the aperture 10.

Also the central puppet 20 of FIG. 1 may have a different arrangement: in this case the hollow body is connected to a truncated cone 21 by means of a ring 22, preferably made of plastic material. The truncated cone 21 constitutes the rigid base of the puppet 20 such that the whole puppet can be extracted from the toy-theater to be used indipendently.

The animated toy puppet theater is completed by a cover 4 hinged at the frame 3 by means of hinges 14. The cover 4 has its internal surface 4*a* painted, or otherwise decorated, such that, when opened at a right angle with respect to the frame surface 3*a*, it becomes the background of the toy-theater scene.

What has been provided, therefore, is an animated toy puppet theater fitted with automatically animated puppets, of a very simple and economic design which makes it reliable and safe in use.

While particular embodiments of the present invention have been shown and described, it will be obvious that changes and modifications may be made without departing from this invention in its broader aspects.

In practice, materials and dimensions may be any according to needs and the state of the art.

I claim:

1. Animated toy puppet theater comprising, at least one box-like frame, at least one top surface defined by said box-like frame, at least one hole formed in said top surface, at least one rear panel defined by said box-like frame and being arranged substantially perpendicular to said top surface, at least one puppet having at least one head, and at least one hollow body, said hollow body being made of flexible material and connected to said head and to said top surface of said box- like frame.

at least one rod connected to said head, at least one lower portion defined by said rod and extending through said hole into said box-like frame below said top surface, at least one motor connected to said box-like frame and adapted for generating motion, transmission means adapted for transmitting said motion generated by said motor for automatically causing movement of said rod with respect to said top surface of said box-like frame, means for permitting manual movement of said rod with respect to said top surface of said box-like frame, guide means adapted for guiding said movement of said rod with respect to said top surface of said box-like frame, at least one cover pivotally connected to said box-like frame and being adapted for defining at least one open position, at least one internal surface defined by said cover and being adapted to lie substantially perpendicular to said top surface in said open position of said cover, and, at least one background panel defined by said internal surface.

2. Animated toy puppet theater acording to claim 1, wherein said transmission means comprise, at least one cam-shaft extending substantially below said rod and having imparted thereto said motion generated by said motor.

at least one cam follower rigidly associated with said bottom portion of said rod at least one cam rigidly associated with said cam-shaft and acting on said cam follower to cause substantially vertical movements of said rod and said cam follower and flexing of said hollow body connected to said head and to said top surface for automatically animating said puppets.

3. Animated toy puppet theater according to claim 1, wherein said transmission means comprise, at least one cam-shaft extending substantially below said rod and having imparted thereto said motion generated by said motor, at least one cam follower rigidly associated with said bottom portion of said rod at least one cam rigidly associated with said cam-shaft and acting on said cam follower to cause substantially vertical movements of said rod and said cam follower and flexing of said hollow body connected to said head and to said top surface for automatically animating said puppets, and wherein said means for permitting manual movement of said rod with respect to said top surface of said box-like frame comprise at least one aperture, said aperture being formed in said rear panel of said box-like frame and being adapted for providing access for effecting manual movement of said lower portion defined by said rod, thereby causing manual movement of said rod and said cam follower and flexing of said hollow body connected to said head and said top surface.

4. Animated toy puppet theater according to claim 1, wherein said guide means comprise at least one elastic ring, said elastic ring being located at said hole formed in said top surface of said box-like frame and being adapted for supporting and guiding said rod when displaced by said transmission means and said motor means, and when displaced manually through said means for permitting manual movement of said rod with respect to said top surface of said boxlike frame.

5. Animated toy puppet theater according to claim 4, wherein said motor means and said transmission means cause displacement movement of said rod at least in a substantially vertical direction, and wherein said elastic ring is adapted for permitting inclination of said rod with respect to said substantially vertical direction when actuated manually through said means for permitting manual movement of said rod with respect to said top surface of said box-like frame.

6. Animated toy puppet theater according to claim 1, wherein said hollow body further comprises at least one horn-like base, said horn-like base being associated with said puppet at said hole formed in said top surface.

7. Animated top puppet theater according to claim 6, wherein said guide means comprise at least one elastic ring, and wherein said horn-like base has formed therein at least one base hole, said rod being inserted through said base hole, said elastic ring being interposed between said rod and said base hole.

8. Animated toy puppet theater according to claim 6, wherein said means for permitting manual movement of said rod with respect to said top surface of said box-like frame comprise at least one aperture, said aperture being formed in said rear panel of said box-like frame and being adapted for providing access for effecting manual movement of said lower portion defined by said rod, thereby causing manual movement of said rod and flexing of said hollow body connected to said head and said top surface, and wherein said horn-like base has at least one extremity and at least one whistle having at least one mouthpiece, said whistle being associated with said extremity, said mouthpiece of said whistle being located at said aperture.

9. Animated toy puppet theater comprising, at least one box-like frame, at least one top surface defined by said box-like frame, at least one hole formed in said top surface, at least one rear panel defined by said box-like frame and being arranged substantially perpendicular to said top surface, at least one puppet having at least one head, and at least one hollow body, at least one connecting ring, and at least one puppet base, said puppet base being rigid, said hollow body being made of flexible material and connected to said head, said connecting ring connecting said hollow body to said puppet base, at least one rod connected to said head, at least one lower portion defined by said rod, said lower portion and said puppet base extending through said hole into said box-like frame below said top surface, said lower portion of said rod extending below said puppet base, at least one motor connected to said box-like frame and adapted for generating motion, transmission means adapted for transmitting said motion generated by said motor for automatically causing movement of said rod with respect to said top surface of said box-like frame, means for permitting manual movement of said rod with respect to said top surface of said box-like frame, at least one cover pivotally connected to said box-like frame and being adapted for defining at least one open position, at least one internal surface defined by said cover and being adapted to lie substantially perpendicular to said top surface in said open position of said cover, and, at least one background panel defined by said internal surface.

10. Animated toy puppet theater acording to claim 9, wherein said transmission means comprise, at least one cam-shaft extending substantially below said rod and having imparted thereto said motion generated by said motor, at least one cam follower rigidly associated with said bottom portion of said rod at least one cam rigidly associated with said cam-shaft and acting on said cam follower to cause substantially vertical movements of said rod, said cam follower, and said hollow body for automatically animating said puppets.

11. Animated toy puppet theater according to claim 9, wherein said transmission means comprise, at least one cam-shaft extending substantially below said rod and having imparted thereto said motion generated by said motor, at least one cam follower rigidly associated with said bottom portion of said rod at least one cam rigidly associated with said cam-shaft and acting on said cam follower to cause substantially vertical movements of said rod, said cam follower, and said hollow body for automatically animating said puppets, and, wherein said means for permitting manual movement of said rod with respect to said top surface of said box-like frame comprise at least one aperture, said aperture being formed in said rear panel of said box-like frame and being adapted for providing access for effecting manual movement of said lower portion defined by said rod, thereby causing manual movement of said rod, said cam follower, and said hollow body.

12. Animated toy puppet theater according to claim 9, wherein said puppet base defines a substantially truncated cone configuration.

13. Animated toy puppet theater comprising, at least one box-like frame, at least one top surface defined by said box-like frame, at least one hole formed in said top surface, at least one rear panel defined by said box-like frame and being arranged substantially prependicular to said top surface, at least one puppet having at least one head, and at least one hollow body, said hollow body being made of flexible material and connected to said head and to said top surface of said box- like frame, at least one rod connected to said head, at least one lower portion defined by said rod and extending through said hole into said box-like frame below said top surface, at least one motor connected to said box-like frame and adapted for generating motion, transmission means adapted for transmitting said motion generated by said motor for automatically causing movement of said rod with respect to said top surface of said box-like frame, means for permitting manual movement of said rod with respect to said top surface of said box-like frame, and guide means adapted for guiding said movement of said rod with respect to said top surface of said box-like frame, wherein said transmission means comprise, at least one cam-shaft extending substantially below said rod and having imparted thereto said motion generated by said motor, at least one cam follower rigidly associated with said bottom portion of said rod at least one cam rigidly associated with said cam-shaft and acting on said cam follower to cause substantially vertical movements of said rod and said cam follower and flexing of said hollow body connected to said head and to said top surface for automatically animating said puppets, and wherein said means for permitting manual movement of said rod with respect to said top surface of said box-like frame comprise at least one aperture, said aperture being formed in said rear panel of said box-like frame and being adapted for providing access for effecting manual movement of said lower portion defined by said rod, thereby causing manual movement of said rod and said cam follower and flexing of said hollow body connected to said head and said top surface.

14. Animated toy puppet theater according to claim 13, wherein said guide means comprise at least one elastic ring, said elastic ring being located at said hole formed in said top surface of said box-like frame and being adapted for supporting and guiding said rod when displaced by said transmission means and said motor means, and when displaced manually through said means for permitting manual movement of said rod with respect to said top surface of said box-like frame.

15. Animated toy puppet theater according to claim 14, wherein said motor means and said transmission means cause displacement movement of said rod at least in a substantially vertical direction, and wherein said elastic ring is adapted for permitting inclination of said rod with respect to said substantially vertical direction when actuated manually through said means for permitting manual movement of said rod with respect to said top surface of said box-like frame.

16. Animated toy puppet theater according to claim 13, wherein said hollow body further comprises at least one horn-like base, said horn-like base being associated with said puppet at said hole formed in said top surface.

17. Animated toy puppet theater according to claim 16, wherein said guide means comprise at least one elastic ring, and wherein said horn-like base has formed therein at least one base hole, said rod being inserted through said base hole, said elastic ring being interposed between said rod and said base hole.

18. Animated toy puppet theater according to claim 16, wherein said means for permitting manual movement of said rod with respect to said top surface of said box-like frame comprise at least one aperture, said aperture being formed in said rear panel of said box-like frame and being adapted for providing access for effecting manual movement of said lower portion defined by said rod, thereby causing manual movement of said rod and flexing of said hollow body connected to said head and said top surface, and wherein said horn-like base has at least one extremity and at least one whistle having at least one mouthpiece, said whistle being associated with said extremity, said mouthpiece of said whistle being located at said aperture.

19. Animated toy puppet theater according to claim 13, further comprising, at least one cover pivotally connected to said box-like frame and being adapted for defining at least one open position, at least one internal surface defined by said cover and being adapted to lie substantially perpendicular to said top surface in said open position of said cover, and, at least one background panel defined by said internal surface.

* * * * *